US006679379B1

(12) United States Patent
Kao

(10) Patent No.: US 6,679,379 B1
(45) Date of Patent: Jan. 20, 2004

(54) TOOL SUSPENSION DEVICE

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 0 days.

(21) Appl. No.: 10/209,457

(22) Filed: Jul. 30, 2002

(51) Int. Cl.[7] ..... B65D 75/56

(52) U.S. Cl. ..... 206/349; 206/378; 206/481; 206/806; 211/70.6

(58) Field of Search ..... 206/349, 372–378, 206/477, 480–482, 806; 211/70.6; 248/309.1, 222.11, 222.12

(56) References Cited

U.S. PATENT DOCUMENTS 5,713,467 A * 2/1998 Kao ..... 206/349
5,906,350 A * 5/1999 Kao ..... 206/349
5,996,817 A * 12/1999 Kao ..... 211/70.6
6,076,669 A * 6/2000 Ling ..... 206/349
6,164,463 A * 12/2000 Lee ..... 206/376
6,193,200 B1 * 2/2001 Kao ..... 206/349
6,315,119 B1 * 11/2001 Lee ..... 206/349
6,378,700 B1 * 4/2002 Tong ..... 206/376

* cited by examiner

*Primary Examiner*—Luan K. Bui
(74) *Attorney, Agent, or Firm*—Jackson Walker L.L.P.

(57) ABSTRACT

A tool suspension device consists of a back-plate (10) and a tool bracket (20) to hang a tool on the tool suspension device. The back-plate (10) has two holding plates (11) respectively formed at two sides of the back-plate (10). Each holding plate (11) forms a mounting slot (12) with the back-plate (10). A hole (15) is defined in the back-plate (10) and a resilient arm (16) with a hook (17) is formed within the hole and protrudes to block the mounting slot (12). The tool bracket (20) has two ears (23). Each ear (23) slides into and is securely held in the corresponding mounting slot (12) by means of the hook (17) locking the mounting slot (12). The tool suspension device further has at least one lip secured on the back plate to keep the tool stable.

12 Claims, 12 Drawing Sheets

TOOL SUSPENSION DEVICE

BACKGROUND OF THE INVENTION

1. Field of the Invention

The present invention relates to a tool suspension device, and more particularly a tool suspension device that holds a tool and provides security and anti-thief features when displaying a tool with a tool head.

2. Description of Related Art

With reference to FIG. 15, a conventional tool suspension device in accordance with the prior art is composed of a back-plate (50) and a tool bracket (60) attached to the back-plate (50).

The back-plate (50) is rectangular and has a bottom edge, a top edge and two side edges. Two mortises (51) are respectively defined near the bottom edge and opposite side edges of the back-plate (50). A through hole (52) is defined in the back-plate (50) between each mortise (51) and the corresponding side edge.

The tool bracket (60) is substantially U-shaped with a receiving space (61) to hold a tool (not shown) and has two sides. An ear (62) is formed at each side of the receiving space (61). Each ear (62) has a face (not numbered) to abut the back-plate (50) and a lipped protrusion (64) formed on the face to engage the corresponding mortise (51) to attach the tool bracket (60) to the back-plate (50) to suspend a tool between the back-plate (50) and the tool bracket (60). A through hole (65) is defined in each ear (62) near the lipped protrusion (64) to align with the corresponding through hole (52) in the back-plate (50). A plug (63) with a shaft and two ends has a head (not numbered) on one end and a lip (not numbered) on the other end. The shaft is partially split longitudinally so the lip and the shaft can be pressed through the through hole (65) in the ear (62) and the through hole in the back-plate (52) and provide an anti-thief feature.

However, the conventional tool suspension device still has the following drawbacks:

1. The lipped protrusion (64) on the tool bracket (60) detachably engages the mortise (51) in the back-plate (50) to hold the tool on the tool suspension device. However, the lipped protrusion (64) is easily broken when the tool bracket (60) detaches from the back-plate (50) several times or when the tool bracket (60) holds a heavy tool. Therefore, the conventional suspension device is not durable.

2. When using the lipped protrusion (64) and the mortise (52) to mount the tool, the conventional suspension device further needs the plug (63) to achieve the anti-thief effect. Therefore, manufacturers need two attachment processes to assemble the conventional tool suspension device, and that makes the assembly of the conventional tool suspension device unnecessarily time-consuming and troublesome. Furthermore, production cost of the conventional tool suspension device is also raised.

To eliminate the foregoing disadvantages of the conventional tool suspension device, the present invention provides a tool suspension device that is conveniently assembled, which stably holds a tool on the tool suspension device.

SUMMARY OF THE INVENTION

A first objective of the invention is to provide a tool suspension device that is convenient to assemble or disassemble.

A second objective of the invention is to provide a tool suspension device that holds a tool stably.

Other objects, advantages and novel features of the invention will become more apparent from the following detailed description when taken in conjunction with the accompanying drawings.

DETAILED DESCRIPTION OF THE PREFERRED EMBODIMENT

Figure 1:
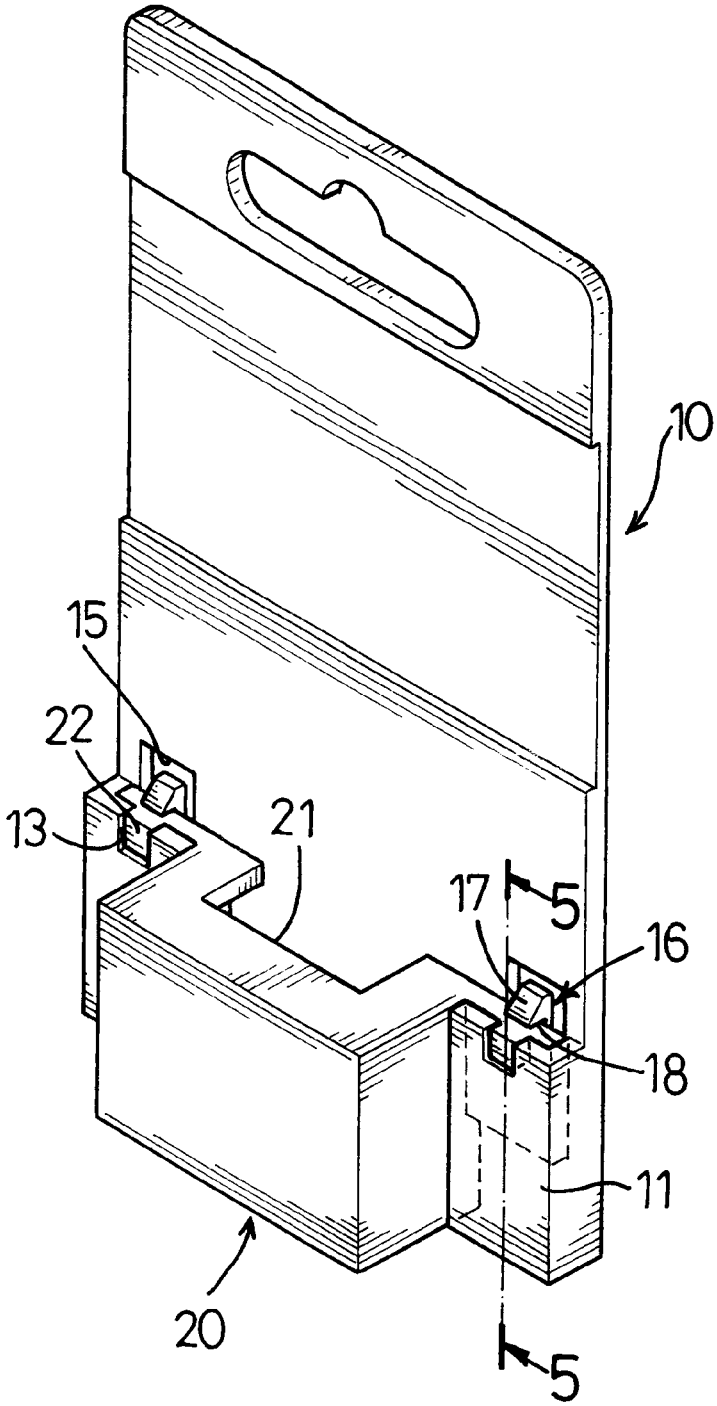
FIG. 1 is a perspective view of a tool suspension device in accordance with the present invention.
Figure 2:
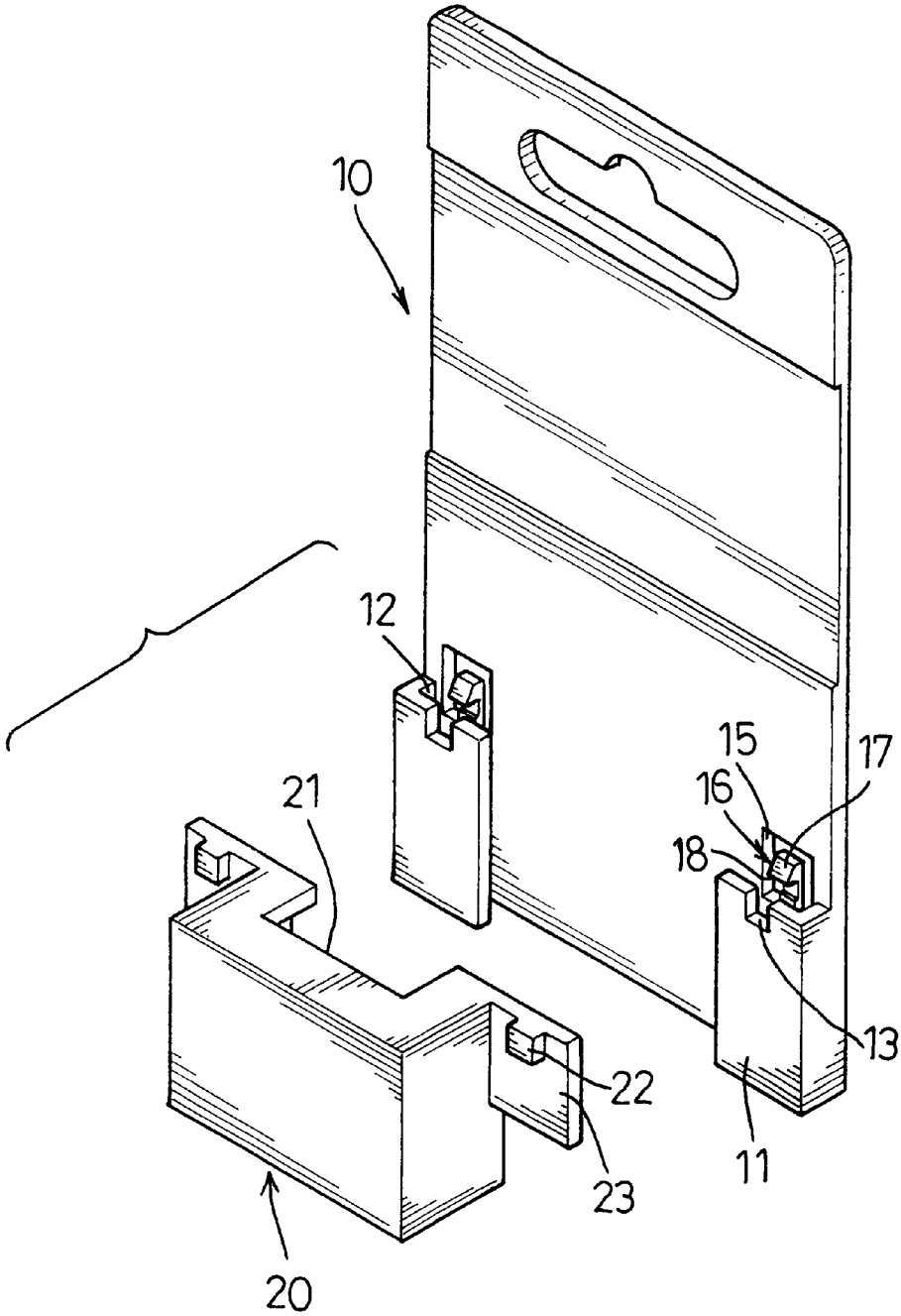
FIG. 2 is an exploded perspective view of the tool suspension device in FIG. 1.

With reference to FIGS. 1 and 2, a tool suspension device comprises a back-plate (10) and a tool bracket (20). The tool bracket (20) is detachably mounted on the back-plate (10) to hold a tool (not shown) between the back-plate (10) and the tool bracket (20).

The back-plate (10) is rectangular and has a bottom, a top, two sides and four corners. Two holding plates (11) each with a top, a bottom and two sides are attached to each side of the back-plate (10) and each holding plate (11) extends toward the other holding plate (11). A mounting slot (12) is defined between each holding plate (11) and the back plate (10), and a notch (13) is defined through the top of each holding plate (11). The back-plate(10) has a retaining device to lock the tool bracket (20) on the back-plate to provide an anti-thief efficiency. The retaining device consists of two rectangular holes (15) with bottom edges are respectively defined in the back-plate (10) at a position aligned with the notches (13) in the holding plates (11). A resilient arm (16) is formed on the bottom edge inside each rectangular hole (15). The resilient arm (16) has a distal end that extends upward beyond the top of the respective holding plate (11). A hook (17) with a flat bottom lip (18) is formed on the distal end of the resilient arm (16).

The tool bracket (20) has a middle portion, two sides and a bottom. A receiving space (21) with an opening (not numbered) is defined in the middle portion of the tool bracket (20). The opening faces the back-plate (10). Two ears (23) are respectively formed at opposite sides of the tool bracket (20) to correspond to the mounting slots (12) on the back-plate (10). Each ear (23) has a top, a bottom and a nub (22). The nub (22) is formed at the top of the ear (23) to engage the notch (13) in the respective holding plate (11).

Figure 3:
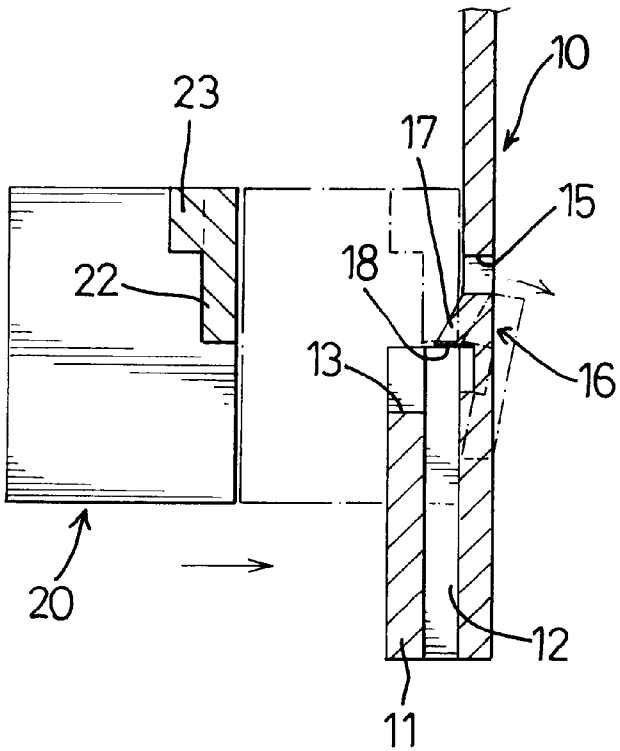
FIG. 3 is an enlarged operational side plan view in partial section of the tool suspension device in FIG. 1.
Figure 4:
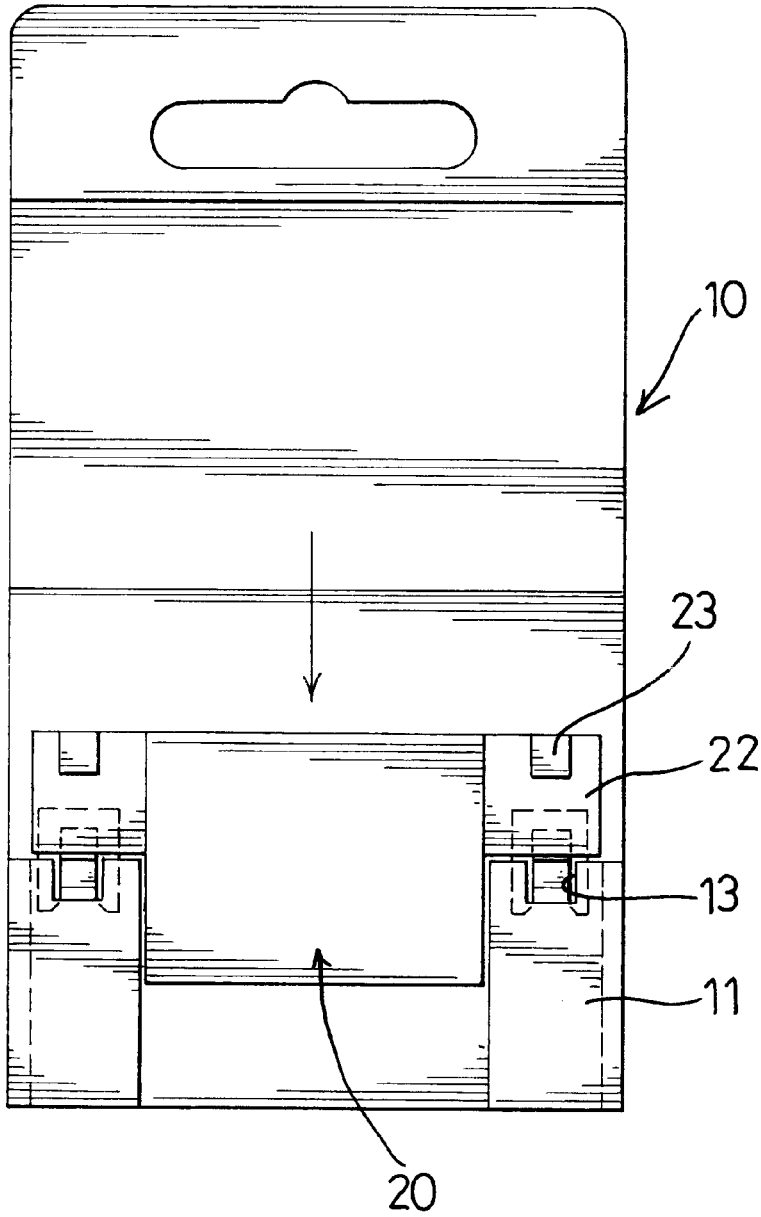
FIG. 4 is an operational front plan view of the tool suspension device in FIG. 1.

With reference to FIGS. 3 and 4, when attaching the tool bracket (20) on the back-plate (10), the tool bracket (20) is pressed against the back plate (10) and then slid downward along the back-plate (10) so the ears (23) slide into the corresponding mounting slots (12). The resilient arm (16) is pressed into the rectangular hole (15) if the back-plate (10). The tool bracket (20) moves downward until the nub (22) rests inside the, notch (13) and the hook (17) on the resilient arm (16) extends above and hooks the top of the ear (23) of the tool bracket (20) to prevent the tool bracket (20) from sliding up to achieve anti-thief feature. Therefore, only one step is needed to assemble the tool suspension device.

Figure 5:
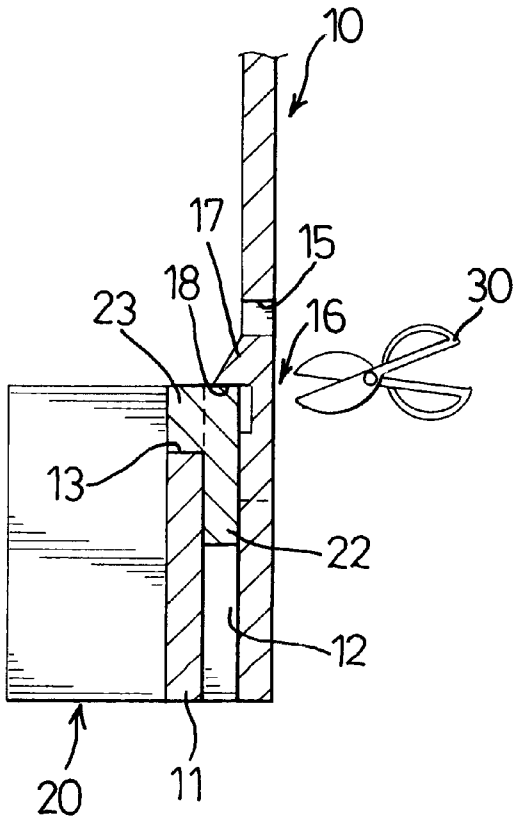
FIG. 5 is an enlarged cross-sectional side plan view of a retaining device of the tool suspension device along line 5—5 in FIG. 1.

With reference to FIG. 5, to remove the tool from the tool suspension device, scissors (30) are used to cut the hook (17) of the resilient arm (16) off so the tool bracket (20) can be slid out of the mounting slots (12) and be detached from the back-plate (10). Furthermore, the flat bottom lip (18) of the hook (17) extends above the top of the respective holding plate (11) to form a gap between the hook (17) and the holding plate (11) so that the scissors (30) can cut the hook (17) off the resilient arm (16) easily. After the hook (17) is cut off the resilient arm (16), the tool bracket (20) can be easily detached from or re-attached to the back-plate (10) so the tool suspension device can be used to store tools. Since the nub (22) and notch (13) are not easily broken, the tool suspension device is durable.

Figure 6:
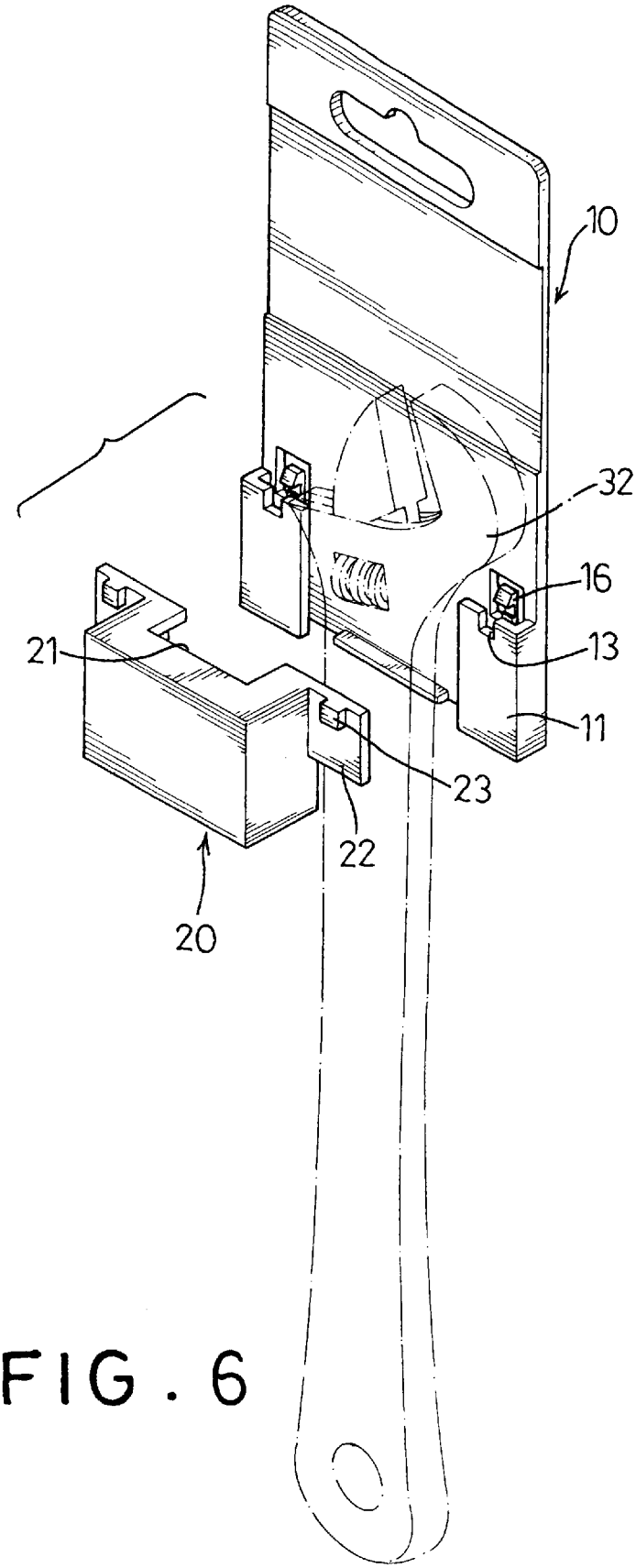
FIG. 6 is an exploded perspective view of a second embodiment of the tool suspension device in accordance with the present invention, wherein a lip is mounted on the back-plate inside the receiving space.
Figure 7:
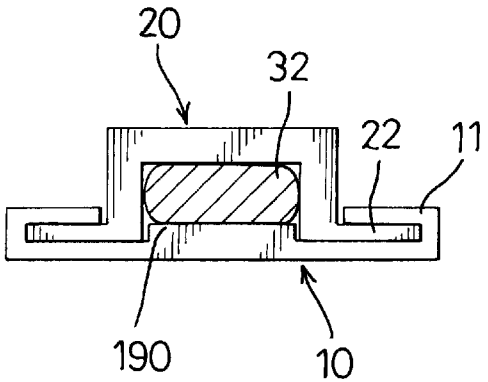
FIG. 7 is a cross-sectional top plan view of the tool suspension device in FIG. 6.

With reference to FIGS. 6 and 7, a second embodiment of the tool suspension device in accordance with the present invention improves the stability a tool suspended on the device. A wrench (32) having a relatively flat handle and an enlarged head is secured inside the receiving space (21) between the back-plate (10) and the tool bracket (20). A lip (190) and is mounted on the back-plate (10) to fill extra space within the receiving space (21). Therefore, the wrench (32) does not tilt or swing in the receiving space (21)and is kept straight.

Figure 8:
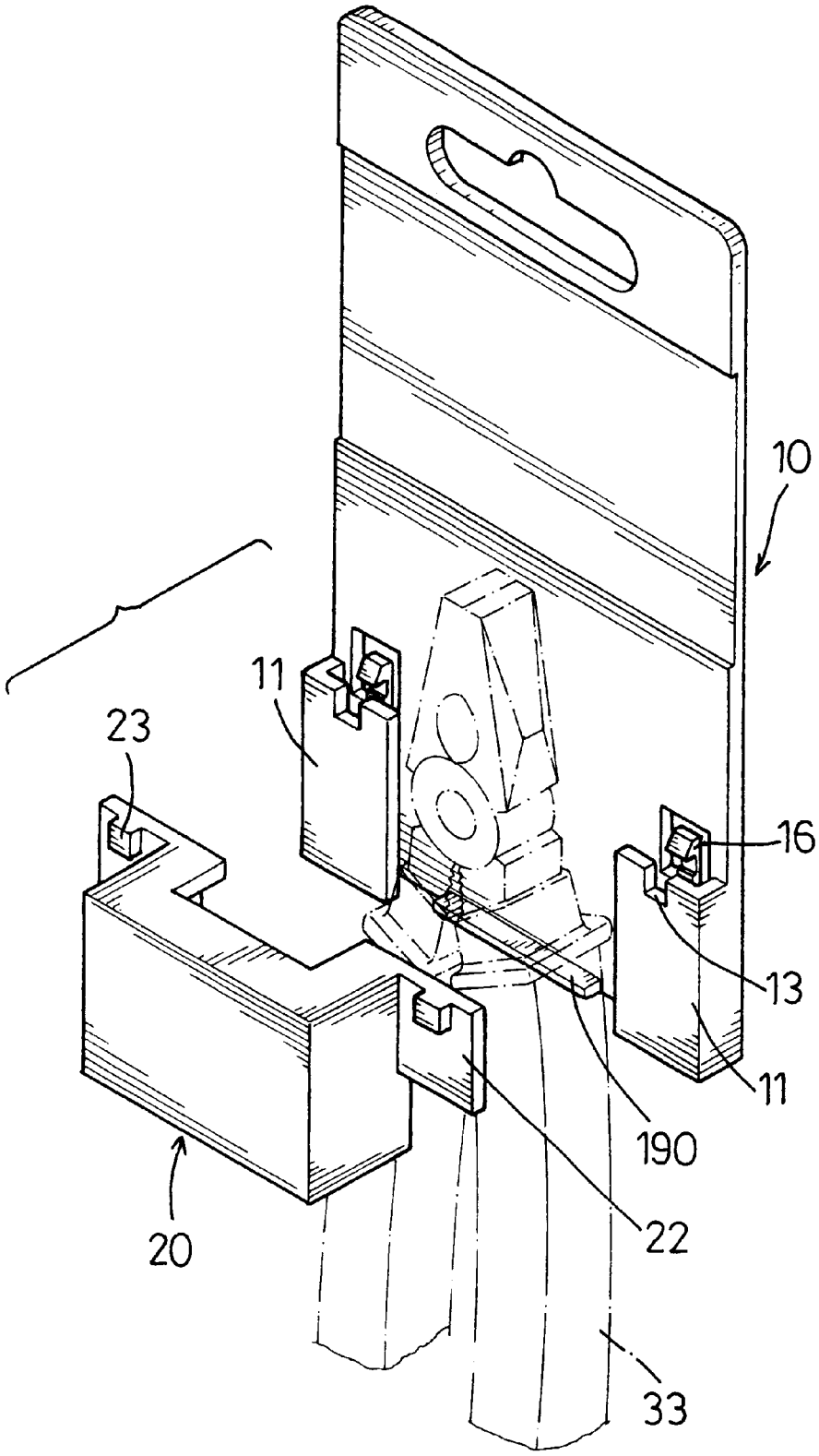
FIG. 8 is an exploded perspective view of a third embodiment of the tool suspension device in accordance with the present invention, wherein the tool is a pair of pliers.
Figure 9:
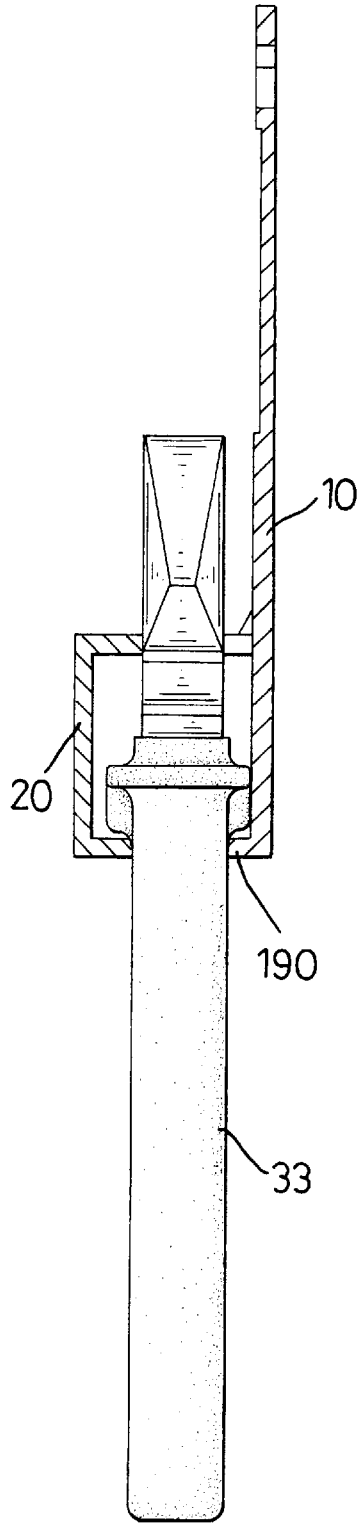
FIG. 9 is a cross-sectional side view of the tool suspension device in FIG. 8.
Figure 10:
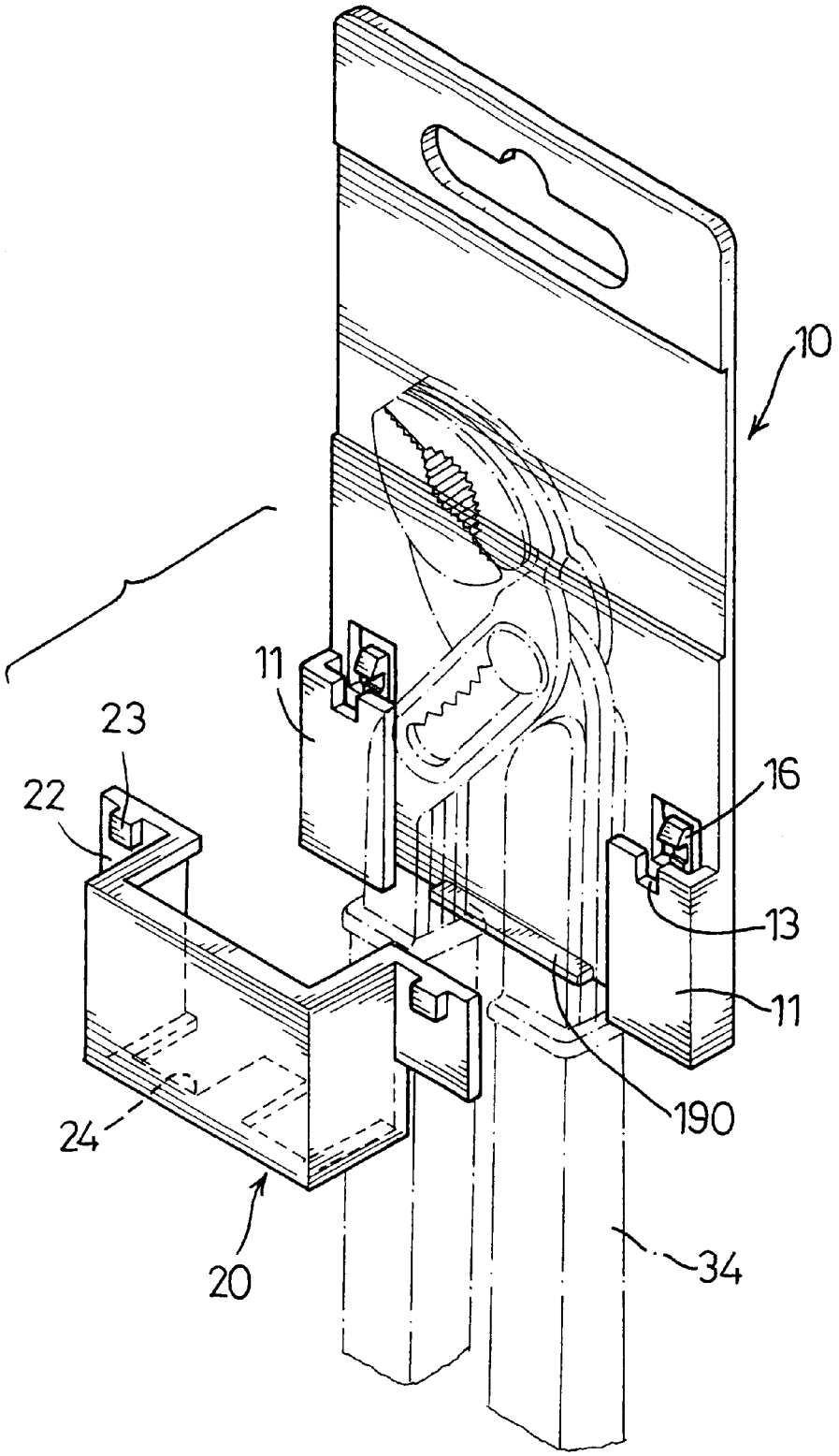
FIG. 10 is an exploded perspective view of the tool suspension device in FIG. 8, wherein the tool is a pair of channel lock pliers.

With reference to FIGS. 8 to 10, a third embodiment of the tool suspension device is modified to hold pliers (33, 34) having a pair of handles. The tool bracket (20) further has two cutouts (24) defined in the bottom of the tool bracket (20) for receiving the pair of handles to hold the pliers.

Figure 12:
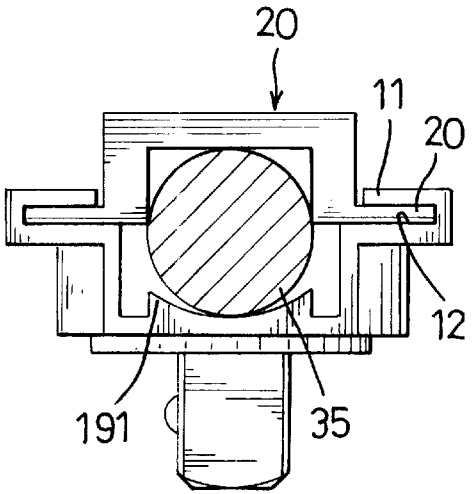
FIG. 12 is a cross-sectional top plan view of the tool suspension device in FIG. 11.
Figure 11:
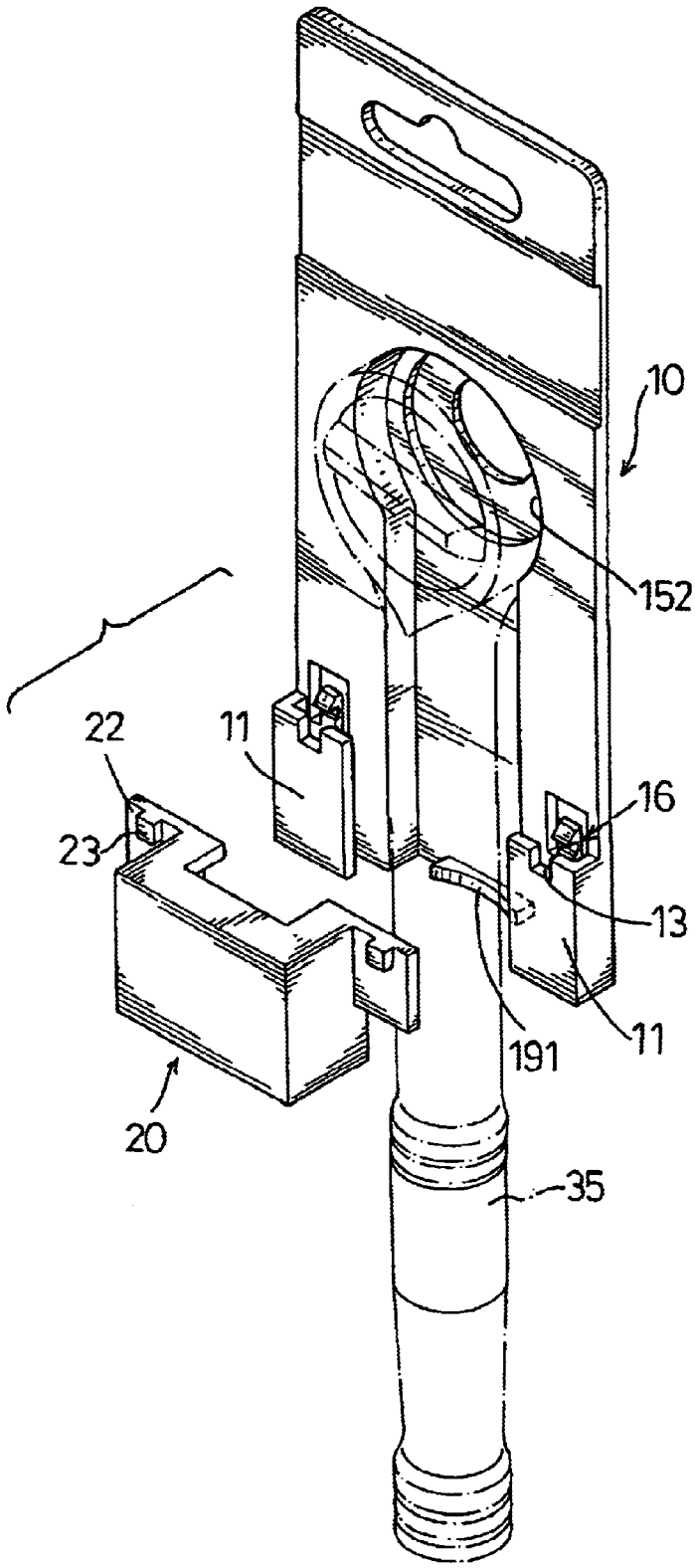
FIG. 11 is an exploded perspective view of a fourth embodiment of the tool suspension device in accordance with the present invention, wherein the tool is a socket wrench handle.

With reference to FIGS. 11 and 12, a fourth embodiment of the tool suspension device has a tool head recess (152) defined in the back-plate (10) to partially receive a tool head inside. A round socket wrench handle (35) is held between the back-plate (10) and the tool bracket (20). A curved positioning lip (191) is mounted on the back-plate (10) to correspond to the round handle and fill space between the handle and the tool suspension device.

Figure 14:
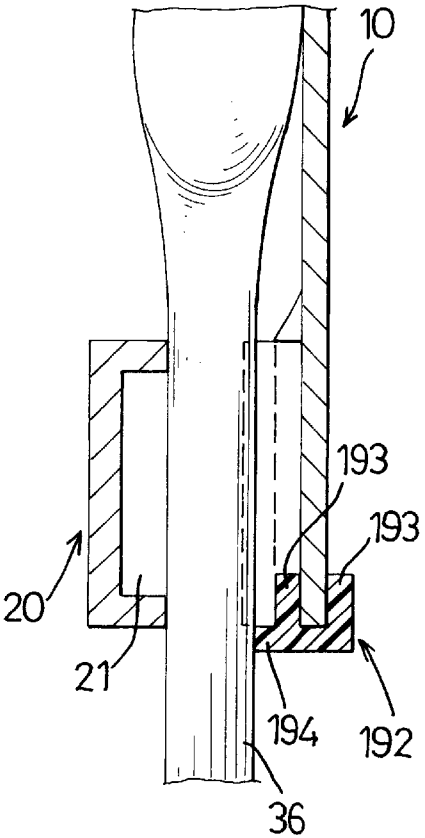
FIG. 14 is a cross-sectional side plan view of the tool suspension device in FIG. 13.
Figure 13:
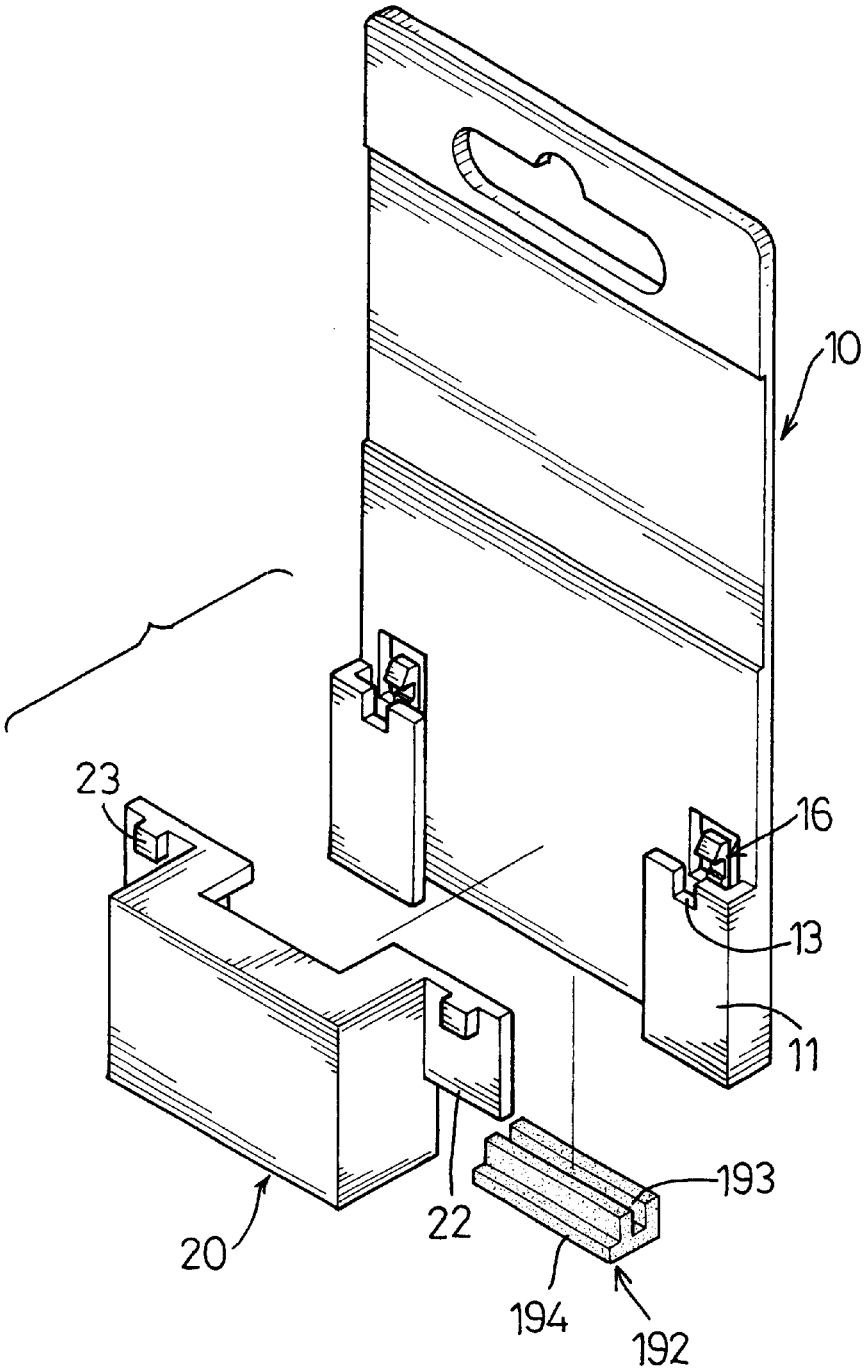
FIG. 13 is an exploded perspective view of a fifth embodiment of the tool suspension device in accordance with the present invention, wherein a resilient block is mounted on a bottom edge of the back-plate.
Figure 15:
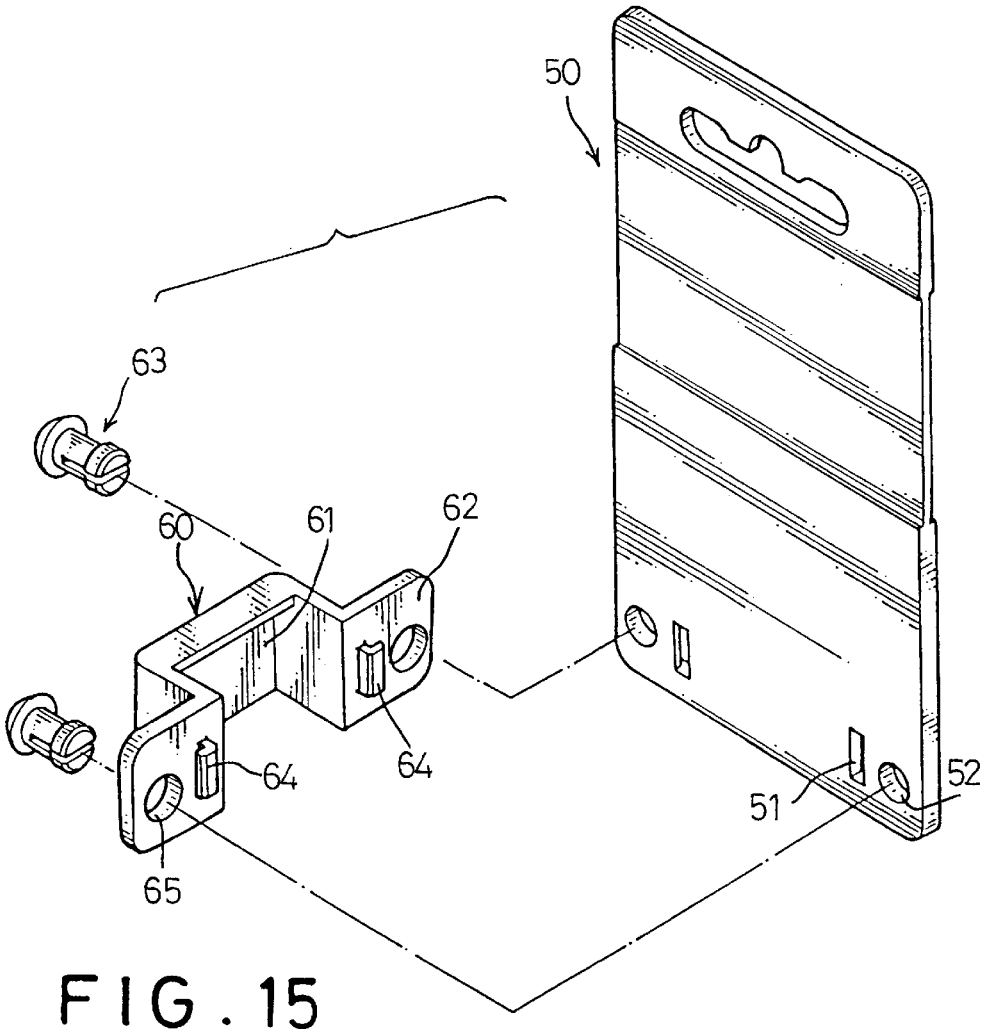
FIG. 15 PRIOR ART
FIG. 15 is an exploded perspective view of a conventional tool suspension device in accordance with the prior art.

With reference to FIGS. 13 and 14, a fifth embodiment of the tool suspension device further has a detachable lip (192) attached to the bottom of the back plate (10). The detachable lip (192) has a holding groove (193) defined in a top face of the detachable lip (192) for receiving the bottom edge of the back plate (10). A flange (194) extends from the detachable lip (192) toward the tool bracket (290) to press the handle of the tool against the tool bracket (20), whereby the wrench (36) is stably secured on the tool suspension device.

Based on the foregoing description, the tool suspension device in accordance with the present invention has the following advantages.

1. When assembling the tool suspension device, the tool bracket (20) attaches to the back-plate (10) by sliding the ears (23) into the mounting slot (12) of the back-plate (10). The nub (22) is received in the notch (13) and the hook (17) locks the ear (23) in the mounting slot (12) to secure the tool bracket (20) on the back-plate (10) and to prevent the tool bracket (20) from sliding up to achieve an anti-thief feature. Therefore, the manufacturer only needs one step to quickly assemble the tool suspension device.

2. Because the back-plate (10) and the tool bracket (20) are formed as individual pieces by injection molding, there is no need to produce an extra component to lock the pieces together. Therefore, production cost is reduced.

3. The positioning device mounted on the tool works with the back-plate (10) and the tool bracket (20) to prevent the tool from tilting or swinging when the tool is secured on the tool suspension device.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool suspension device adapted to hold a tool, and comprising:

a back-plate that is rectangular and has a bottom, a top, two sides and four corners, and the back-plate further comprising:

two holding plates each with a top, a bottom and two sides attached to each side of the back-plate at respective corners near the bottom, and extending toward the other holding plate;

a mounting slot defined between each holding plate and the back-plate;

a notch defined through the top of each holding plate;

a hole defined in the back-plate and aligned with the notch in each holding plate;

a resilient arm having a distal end formed inside each hole to block the mounting slot;

a hook with a flat bottom lip formed on the distal end of the resilient arm; and a tool bracket with a middle portion, a bottom and two sides detachably mounted on the back-plate, and having the tool bracket further comprising:

a receiving space with an opening in the middle portion facing the back-plate; and two ears respectively formed at two sides of the tool bracket to correspond to the mounting slots of the back-plate, wherein each ear has a top, a bottom and a nub formed at the top of the ear to engage the notch in the respective holding plate.

2. The tool suspension device as claimed in claim 1, wherein the back-plate further comprises a tool head recess defined in the back-plate.

3. The tool suspension device as claimed in claim 1, wherein the tool bracket further comprises two cutouts defined in the bottom of the tool bracket.

4. The tool suspension device as claimed in claim 2, wherein the tool bracket further comprises two cutouts defined in the bottom of the tool bracket.

5. A tool suspension device adapted to hold a tool with at least one handle, and comprising:

a back-plate that is rectangular and has a bottom, a top, two sides and four corners, and the back-plate further comprising:

two holding plates each with a top, a bottom and two sides attached to each side of the back-plate at respective corners near the bottom and extending toward the other holding plate;

a mounting slot defined between each holding plate and the back-plate;

a notch defined through the top of each holding plate;

a tool bracket with a middle portion, a bottom and two sides detachably mounted on the back-plate, the tool bracket further comprising:

a receiving space with an opening in the middle portion facing the back-plate;

a retaining device attached between the back-plate and the tool bracket to provide an anti-thief efficiency;

two ears respectively formed at two sides of the tool bracket to correspond to the mounting slots of the back-plate, wherein each ear has a top, a bottom and a nub formed at the top of the ear to engage the notch of the respective holding plate; and at least one positioning device mounted on the back-plate to securely abut the handle of the tool inside the receiving space of the tool suspension device.

6. The tool suspension device as claimed in claim 5, wherein the retaining device further comprises:

a hole defined in the back-plate and aligned with the notch in the respective holding plate;

a resilient arm having a distal end formed inside each hole to block the mounting slot; and a hook with a flat bottom lip formed on the distal end of the resilient arm.

7. The tool suspension device as claimed in claim 6, wherein the back-plate further comprises a tool head recess defined in the back-plate.

8. The tool suspension device as claimed in claim 6, wherein each at least one positioning device is a lip mounted on the back-plate and extending toward to the tool bracket within the receiving space.

9. The tool suspension device as claimed in claim 6, wherein each at least one positioning device is a curved lip.

10. The tool suspension device as claimed in claim 6, wherein each of the at least one positioning devices is a detachable lip secured under the bottom of the back-plate and further comprising:

A holding groove defined in a top face of the detachable lip for receiving the bottom of the back-plate; and a flange extending from the detachable lip toward the tool bracket to press the handle of the tool against the tool bracket.

11. The tool suspension device as claimed in claim 6, wherein the tool bracket further comprises two cutouts defined in the bottom of the tool bracket.

12. The tool suspension device as claimed in claim 7, wherein the tool bracket further comprises two cutouts defined in the bottom of the tool bracket.

* * * * *